US006446753B1

(12) United States Patent
Novak

(10) Patent No.: US 6,446,753 B1
(45) Date of Patent: Sep. 10, 2002

(54) METHOD AND APPARATUS FOR TRAVERSING A FLEXIBLE MEMBER

(75) Inventor: Patrick J. Novak, North Liberty, IA (US)

(73) Assignee: Capital Safety Inc., Red Wing, MN (US)

( * ) Notice: Subject to any disclaimer, the term of this patent is extended or adjusted under 35 U.S.C. 154(b) by 0 days.

(21) Appl. No.: 09/678,190

(22) Filed: Oct. 4, 2000

(51) Int. Cl.[7] ..... A62B 1/00
(52) U.S. Cl. ..... 182/193; 182/5; 188/65.5
(58) Field of Search ..... 182/192, 193, 182/5; 188/65.5

(56) References Cited

U.S. PATENT DOCUMENTS 199,199 A * 1/1878 Greene ..... 182/193
300,090 A * 6/1884 Carson ..... 182/193
524,481 A * 8/1894 Fowler ..... 182/193
933,685 A * 9/1909 Wray ..... 182/192
4,662,475 A * 5/1987 Rutschi ..... 182/192

* cited by examiner

*Primary Examiner*—Alvin Chin-Shue
(74) *Attorney, Agent, or Firm*—IPLM Group, P.A.

(57) ABSTRACT

A descender includes a frame having opposing first and second plates which define a gap therebetween. Three bearing members are movably interconnected between the plates and linked to an operator. A flexible member has opposite end portions which extend in opposite directions, and an intermediate portion which is routed about the bearing members in a manner which forms a knot. Movement of the operator relative to the frame causes the bearing members to move relative to the frame and thereby loosens or tightens the knotted, intermediate portion of the flexible member about the bearing members.

18 Claims, 3 Drawing Sheets

METHOD AND APPARATUS FOR TRAVERSING A FLEXIBLE MEMBER

This application claims the benefit of U.S. Provisional patent application Ser. No. 60/157,645, filed Oct. 4, 1999.

FIELD OF THE INVENTION

The present invention relates to travel of personnel along a flexible support member or purposes of reducing the risk of injury and/or reaching relatively inaccessible places.

BACKGROUND OF THE INVENTION

Various circumstances give rise to the need for travel along a rope or other flexible support member. For example, people are sometimes required to rapidly evacuate an elevated structure. Other situations arise where people find it necessary to move relative to a steep support surface and/or within an open space. In order to facilitate such activity and address safety issues associated therewith, a variety of devices, including descenders, rope grabs, and hoists have been invented and/or manufactured. However, room for improvement remains.

SUMMARY OF THE INVENTION

The present invention provides methods and apparatus for safely traveling along a flexible support member. A preferred embodiment of the present invention may be described as a descender which allows a person to move down a flexible support member at a controllable speed. However, those skilled in the art will recognize that the principles of the present invention may be applied to other types of devices, including fall arresting rope grabs, for example.

A preferred embodiment of the present invention includes a plurality of bearing members movable mounted between opposing plates. A flexible support member is routed about the bearing members in a manner which forms a knot. An operator is linked to the bearing members and operable to change an effective perimeter defined by outwardly facing portions of the bearing members. The size of the perimeter determines the tightness of the knot, which in turn determines the extent to which the apparatus resists movement along the fexible support member. Additional features and/or advantages of the present invention may become more apparent from the detailed description which follows.

BRIEF DESCRIPTION OF THE DRAWING

With reference to the Figures of the Drawing, wherein like numerals represent like arts and assemblies throughout the several views.

DETAILED DESCRIPTION OF THE PREFERRED EMBODIMENT

Figure 1:
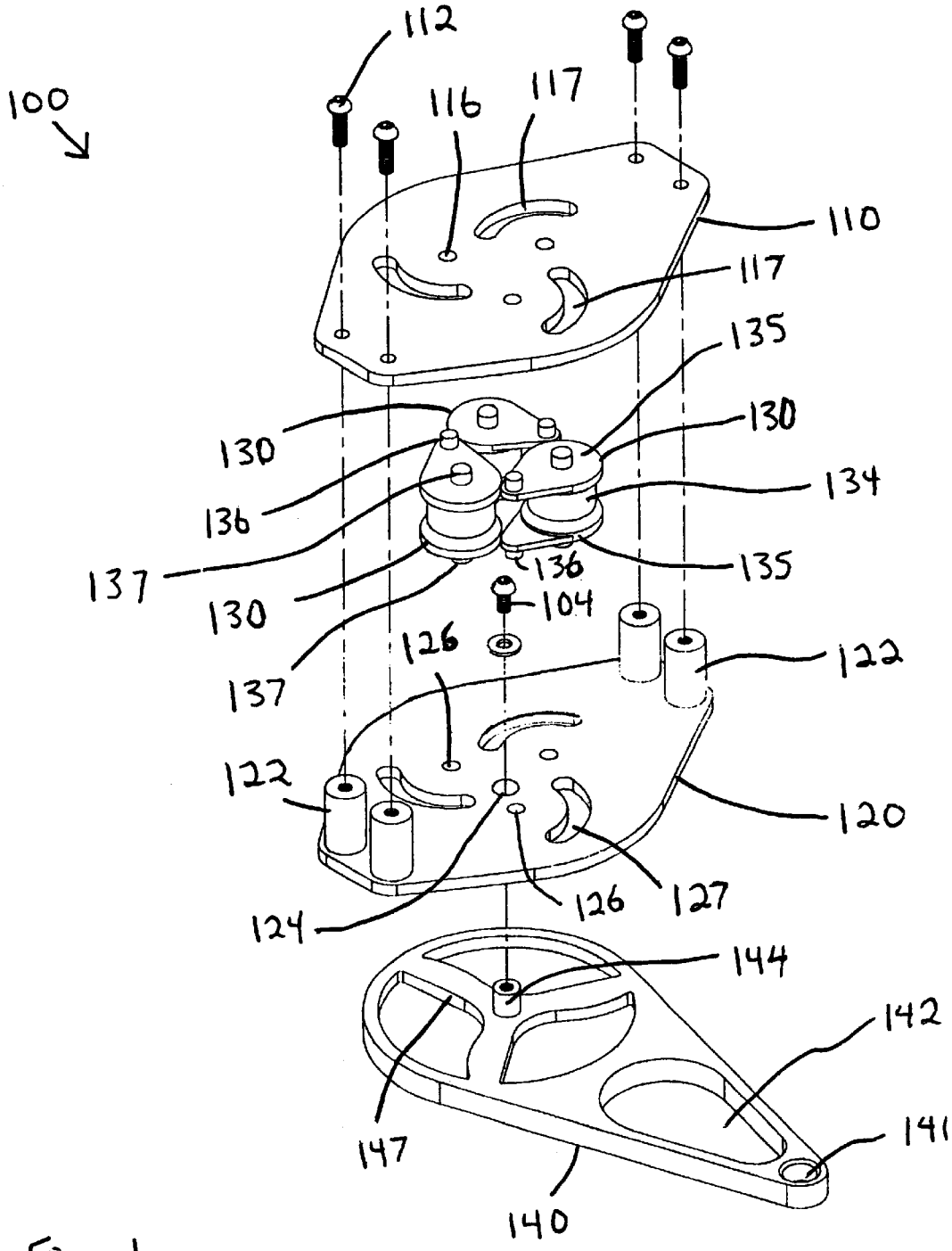
FIG. 1 is an exploded perspective view of a preferred embodiment descender constructed according to the principles of the present invention.
Figure 2:
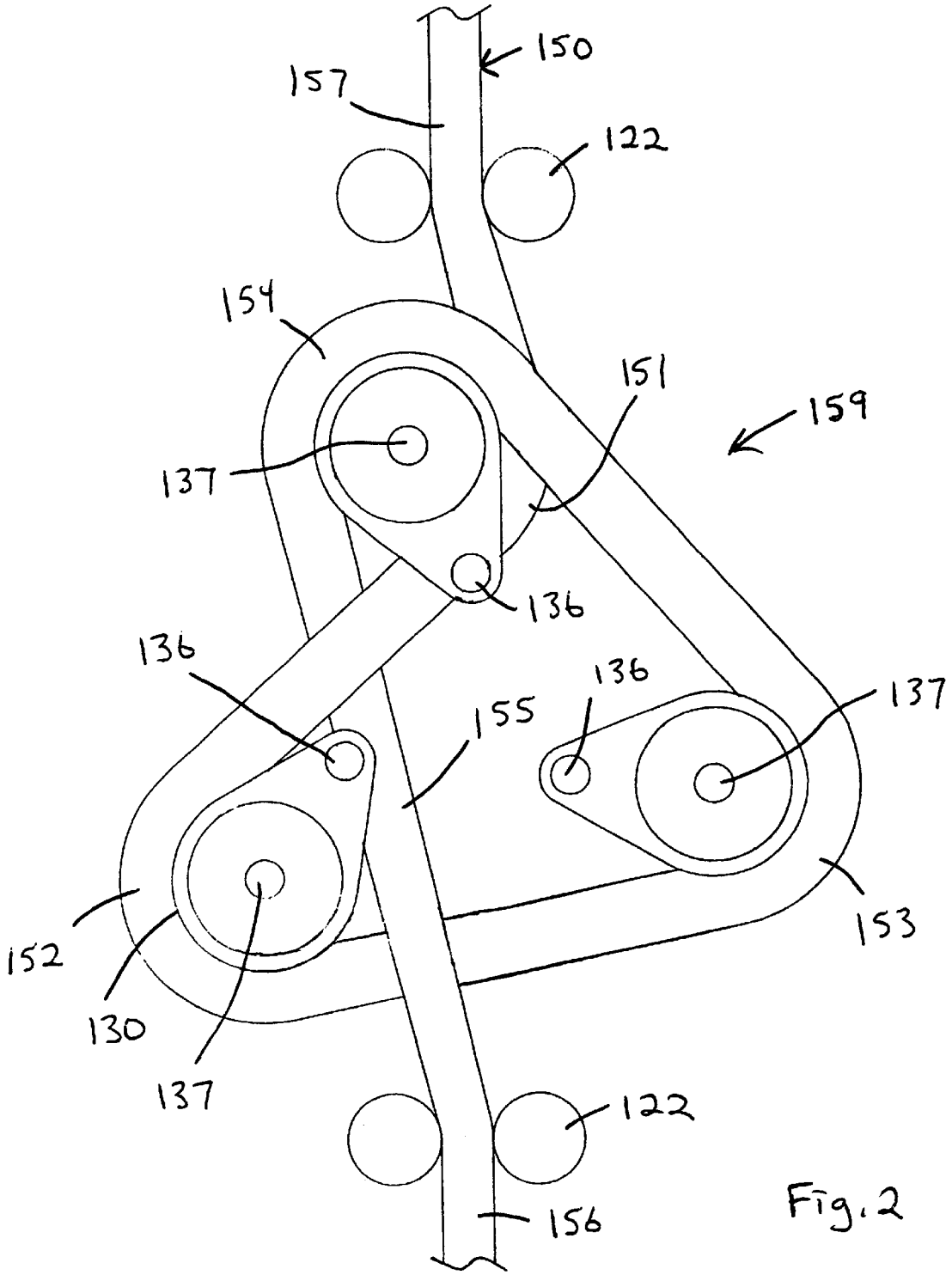
FIG. 2 is a diagrammatic top view of the descender of FIG. 1 secured relative to an intermediate portion of a flexible member.
Figure 3:
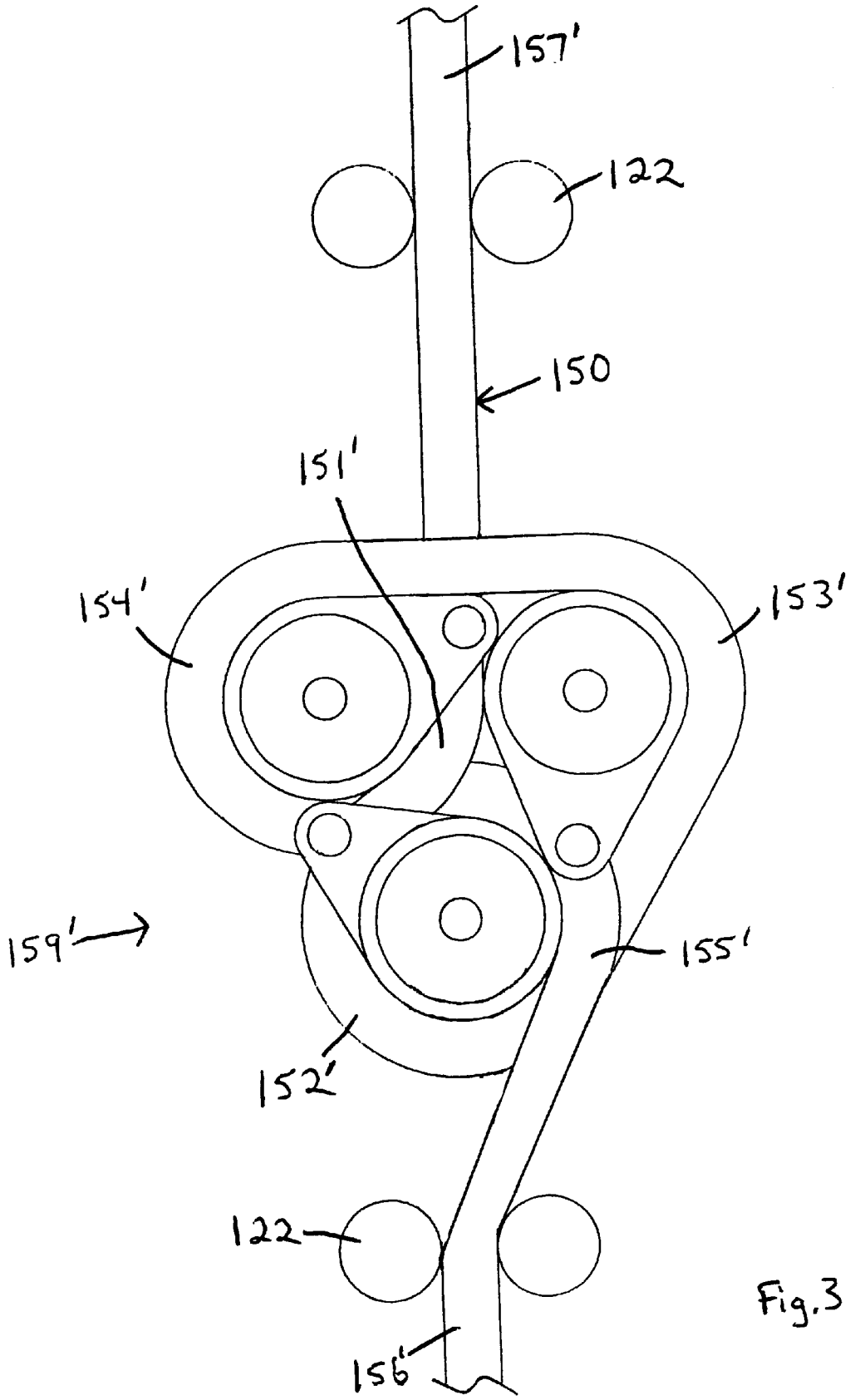
FIG. 3 is a diagrammatic top view of the assembly of FIG. 2 in a second, relatively tighter configuration.

A preferred embodiment descender constructed according to the principles of the present invention is designated as 100 in FIG. 1. The descender 100 generally includes a frame or housing which includes first and second plates 110 and 120; a plurality of bearing members 130 interconnected between the plates 110 and 120; and an operator 140 movably mounted on the plate 120 and linked to the bearing members 130. As shown in FIGS. 2 and 3, a rope 150 or other flexible support member may be routed about the bearing members 130 to provide a safety device suitable for supporting a person relative to a support structure to which an upper portion of the rope 150 is attached.

Except for a central hole 124 through the second plate 120, the plates 110 and 120 are mirror images of one another. Three holes 116 extend through the first plate 110 and are spaced equal distances apart from one another (as if at respective vertices of an equilateral triangle). Three similar holes 126 extend through the second plate 120 and align with the holes 116 in the first plate 110. Three arcuate slots 117 extend through the first plate 110, and each of the slots 117 is centered about a respective hole 116. Each of the slots 117 may be described as extending through approximately ninety degrees with one end directed generally toward one of the holes 116, and the other end extending perpendicular to a line drawn between the other two holes 116. Three similar slots 127 extend through the second plate 120 and align with the slots 117 in the first plate 110.

Each of the bearing members 130 includes a cylindrical member 134 interconnected between opposing, teardrop-shaped plates 135. Those skilled in the art will recognize that the cylindrical members 134 may be rotatable relative to the plates 135 as a matter of design choice. A peg or shaft 136 is mounted on the outwardly facing side of each plate 135, proximate the narrower end thereof. On each of the bearing members 130, one of the pegs 136 projects into a respective hole 116 in the first plate 110, and the other peg 136 projects into a respective hole 126 in the second plate 120. A pin or cam follower 137 is mounted on the outwardly facing side of each plate, proximate the wider end thereof. On the preferred embodiment 100, each of the pins 137 is axially aligned with a respective cylindrical member 134. On each of the bearing members 130, one of the pins 137 projects into a respective slot 117 in the first plate 110, and the other pin 137 projects into a respective slot 127 in the second plate 120.

The operator 140 is a relatively larger teardrop-shaped member or arm which may be manually operated and/or connected to a person's belt, body harness, or other safety garment. A hole 141 extends through the arm 140 proximate the narrower end to receive a fastener such as a snap hook or carabiner. A relatively larger opening 142 extends through an intermediate portion of the arm 140 to facilitate grasping of the arm 140 in a person's hand. A hub 144 is mounted on the arm 140 toward the relatively wider end and extends perpendicular to the remainder of the arm 140. The hub 144 inserts into the central hole 124 in the second plate 120 and is rotatably connected to the second plate 120 by means of a screw 104 which threads into the hub 144.

Three bearing surfaces or cams 147 are provided on the operator 140 at circumferentially spaced locations about the hub 144. Each of the cams 147 bears against a respective cam follower 137 on a respective bearing member 130. The arrangement is such that rotation of the operator 140 in a first direction relative to the second plate 120 causes the bearing members 130 to move toward the configuration shown in FIG. 2, and rotation of the operator 140 in a second, opposite direction relative to the second plate 120 causes the bearing members 130 to move toward the configuration shown in FIG. 3.

Four offsets or posts 122 are rigidly interconnected between the plates 110 and 120 to form the frame or housing.

The posts 122 and the plates 110 and 120 cooperate to establish a gap sufficient in size to accommodate the bearing members 130 and the flexible member 150. The posts 122 are arranged in pairs at opposite ends of the plates 110 and 120, and at opposite edges of the gap defined therebetween. Those skilled in the art will recognize that the posts 122 may be secured between the plates 110 and 120 in a variety of ways. On the preferred embodiment 100, the posts 122 are welded to the second plate 120, and screws 112 are inserted through the first plate 110 and threaded into respective posts 122.

The rope 150 is preferably routed into the housing and about the bearing members 130 in the manner shown in FIGS. 2 and 3. In this regard, the rope 150 may be described with reference to an intermediate portion disposed within the gap, and opposite end portions extending in opposite directions away from the housing. The intermediate portion is routed between a first set of posts 122 (at segment 157 or 157') and about an inwardly facing portion of a first bearing member 130 (at segment 151 or 151'), then about an outwardly facing portion of a second bearing member 130 (at segment 152 or 152'), then about an outwardly facing portion of a third bearing member 130 (at segment 153 or 153'), then over itself and about an outwardly facing portion of the first bearing member 130 (at segment 154 or 154'), then under itself and past an inwardly facing portion of the second bearing member 130 (at segment 155 or 155'), and then over itself and between the other set of posts 122 (at segment 156 or 156').

The routing of the rope 150 is such that it forms a knot 159 or 159' about itself, as well as the bearing members 130. Movement of the bearing members 130 causes the knot 159 to tighten or the knot 159' loosen, depending on the direction in which the operator 140 rotates. As the knot 159 tightens, it becomes relatively more difficult to move the apparatus 100 along the rope 150. Conversely, as the knot 159' loosens, it becomes relatively easier to move the apparatus 100 along the rope 150.

Those skilled in the art will recognize that the foregoing arrangement may be used in different ways to accomplish different tasks. For example, in one mode of operation, the apparatus 100 may be used as a rope grab, in which case a belt, harness, or other safety garment is secured relative to the hole 141 in the operator 140. One or more springs may be used to bias the bearing members 130 toward the configuration shown in FIG. 3, and the user may be required to move the operator 140 against the force of the spring in order to move the bearing members 130 toward the configuration shown in FIG. 2, freeing the apparatus 100 for relatively unhindered travel along the rope 150. In another mode of operation, the apparatus 100 may be used as a descender, in which case a user may selectively move the operator 140 relative to the housing to control the speed of descent along the rope 150. Those skilled in the art will also recognize that a motor or other actuator may be connected to the operator 140 and move same in response to a control signal. In other words, the present invention may be incorporated into hoists and the like.

Among other things, the present invention may be described as a safety system, comprising: a frame including a first plate and a second plate secured to one another with a gap defined therebetween; a plurality of bearing members disposed within the gap and interconnected between the first plate and the second plate; a flexible member having an intermediate portion disposed within the gap and manipulated into a knot about the bearing members, and opposite end portions extending in opposite directions; and a means for moving at least one of the bearing members relative to the frame to selectively loosen or tighten the knot in the flexible member.

The foregoing system may include precisely three said bearing members disposed equidistance from one another. The flexible member may be routed into the gap and about an inwardly facing portion of a first bearing member, then about an outwardly facing portion of a second bearing member, then about an outwardly facing portion of a third bearing member, then over itself and about an outwardly facing portion of the first bearing member, then under itself and past an inwardly facing portion of the second bearing member, and then over itself and out of the gap.

The foregoing system may include guide members rigidly interconnected between the first plate and the second plate proximate opposite edges of the gap, and the opposite end portions of the flexible member may be routed through respective guide members. Also, each of the bearing members of the foregoing system may have a cylindrical bearing surface.

The means of the foregoing system may include an operator movably mounted on the frame and linked to the at least one of the bearing members. A cam may be provided on the operator to bear against a cam follower on the at least one of the bearing members. The cam follower may project through a slot in the second plate, and the operator may be disposed on an opposite side of the second plate. In the event that three said bearing members are provided, the operator may include a separate said cam for each of the bearing members. The bearing member(s) may be pivotally connected to the frame, and the slot may be configured as an arc which is centered about a pivot axis defined between the frame and the bearing member(s).

The present invention may also be described in terms of a safety system, comprising: a frame, including a first plate and a second plate secured to one another with a gap defined therebetween; at least three bearing members disposed within the gap and interconnected between the first plate and the second plate; a flexible member having an intermediate portion disposed within the gap, and opposite end portions extending in opposite directions, wherein the intermediate portion is routed into the gap and about an inwardly facing portion of a first bearing member, then about an outwardly facing portion of a second bearing member, then about an outwardly facing portion of a third bearing member, then across itself and about an outwardly facing portion of the first bearing member, then across itself and past an inwardly facing portion of the second bearing member, and then across itself and out of the gap; and a means for moving at least one of the bearing members relative to the frame to selectively lengthen or shorten the intermediate portion of the flexible member routed about the bearing members.

The three bearing members of this alternative system may be similarly connected to the frame and the operator. Also, the means of this alternative system may include an operator movably mounted on the frame and linked to the at least one of the bearing members. A cam on the operator may bear against a cam follower on the at least one of the bearing members. The cam follower may project through a slot in the second plate, and the operator may be disposed on an opposite side of the second plate. The at least one of the bearing members may be pivotally connected to the frame, and the slot may be configured as an arc which is centered about a pivot axis defined between the frame and the at least one of the bearing members.

The present invention may also be described in terms of a method of mounting a safety device on a flexible member, comprising the steps of: providing a frame with opposing first and second plates and a gap defined therebetween; providing bearing members within the gap and interconnected between the plates; and routing the flexible member into the gap and about an inwardly facing portion of a first bearing member, then about an outwardly facing portion of a second bearing member, then about an outwardly facing portion of a third bearing member, then across itself and about an outwardly facing portion of the f first bearing member, then across itself and past an inwardly facing portion of the second bearing member, and then across itself and out of the gap.

The foregoing method may further include the step of selectively moving at least one of the bearing members relative to the frame, and/or the flexible member may be routed so that it first crosses over itself, then crosses under itself, and then crosses over itself, thereby defining a knot.

Although the present invention is described with reference to a preferred embodiment and particular applications, those skilled in the art will recognize additional embodiments and/or applications. For example, one skilled in the may be inclined to route the rope 150 in a different manner about the bearing members 130, and/or to knot the rope 150 about a different arrangement of bearing members which may include fixed bearing members, as well as movable bearing members. Accordingly, the scope of the present invention should be limited only to the extent of the following claims.

What is claimed is:

1. A safety system, comprising:

a frame including a first plate and a second plate secured to one another with a gap defined therebetween;

a plurality of bearing members disposed within the gap and interconnected between the first plate and the second plate;

a flexible member having (a) an intermediate portion disposed within the gap and manipulated into a knot about the bearing members, wherein the knot includes a first segment of the intermediate portion that is formed into a closed loop, and a second segment of the intermediate portion that passes through the closed loop, and (b) opposite end portions extending in opposite directions away from the knot; and a means for moving at least one of the bearing members relative to the frame to selectively loosen or tighten the knot in the flexible member.

2. The safety system of claim 1, wherein the plurality of bearing members includes three said bearing members disposed equidistance from one another.

3. The safety system of claim 1, wherein the flexible member is routed into the gap and about an inwardly facing portion of a first bearing member, then about an outwardly facing portion of a second bearing member, then about an outwardly facing portion of a third bearing member, then over itself and about an outwardly facing portion of the first bearing member, then under itself and past an inwardly facing portion of the second bearing member, and then over itself and out of the gap.

4. The safety system of claim 1, further comprising guide members rigidly interconnected between the first plate and the second plate.

5. The safety system of claim 4, wherein the guide members are disposed proximate opposite edges of the gap, and the opposite end portions of the flexible member are routed between respective guide members.

6. The safety system of claim 1, wherein each of the bearing members of the foregoing system has a cylindrical bearing surface.

7. The safety system of claim 1, wherein the means includes an operator movably mounted on the frame and linked to the at least one of the bearing members.

8. The safety system of claim 7, wherein a cam is provided on the operator to bear against a cam follower on the at least one of the bearing members.

9. The safety system of claim 8, wherein the cam follower projects through a slot in the second plate, and the operator is disposed on an opposite side of the second plate.

10. The safety system of claim 9, wherein the plurality of bearing members includes three said bearing members, and the operator includes a separate said cam for each of the bearing members.

11. The safety system of claim 10, wherein the at least one of the bearing members is pivotally connected to the frame, and the slot is an arc which is centered about a pivot axis defined between the frame and the at least one of the bearing members.

12. A safety system, comprising:

a frame including a first plate and a second plate secured to one another with a gap defined therebetween;

at least three bearing members disposed within the gap and interconnected between the first plate and the second plate;

a flexible member having an intermediate portion disposed within the gap, and opposite end portions extending in opposite directions, wherein the intermediate portion is routed into the gap and about an inwardly facing portion of a first bearing member, then about an outwardly facing portion of a second bearing member, then about an outwardly facing portion of a third bearing member, then across itself and about an outwardly facing portion of the first bearing member, the across itself and past an inwardly facing portion of the second bearing member, and then across itself and out of the gap; and wherein at least one of the bearing members is selectively movable relative to the frame to selectively lengthen or shorten the intermediate portion of the flexible member routed about the bearing members.

13. The safety system of claim 12, wherein an operator is movably mounted on the frame and linked to the at least one of the bearing members.

14. The safety system of claim 13, wherein a cam on the operator bears against a cam follower on the at least one of the bearing members.

15. The safety system of claim 14, wherein the cam follower projects through a slot in the second plate, and the operator is disposed on an opposite side of the second plate.

16. The safety system of claim 15, wherein the at least one of the bearing members is pivotally connected to the frame, and the slot is an arc which is centered about a pivot axis defined between the frame and the at least one of the bearing members.

17. A method of mounting a safety device on a flexible member, comprising the steps of:

providing a frame with opposing first and second plates and a gap defined therebetween;

providing bearing members within the gap and interconnected between the plates; and routing the flexible member into the gap and about an inwardly facing portion of a first bearing member, then about an outwardly facing portion of a second bearing member, then about an outwardly facing portion of a third bearing member, then across itself and about an outwardly facing portion of the first bearing member, the across itself and past an inwardly facing portion of the second bearing member, and then across itself and out of the gap.

18. The method of claim 17, further comprising the step of selectively moving at least one of the bearing members relative to the frame.

* * * * *